US010565921B2

(12) United States Patent
Eom

(10) Patent No.: US 10,565,921 B2
(45) Date of Patent: Feb. 18, 2020

(54) DISPLAY PANEL AND DISPLAY DEVICE

(71) Applicant: LG DISPLAY CO., LTD., Seoul (KR)

(72) Inventor: Euncheol Eom, Gimje-si (KR)

(73) Assignee: LG Display Co., Ltd., Seoul (KR)

( * ) Notice: Subject to any disclaimer, the term of this patent is extended or adjusted under 35 U.S.C. 154(b) by 141 days.

(21) Appl. No.: 15/380,386

(22) Filed: Dec. 15, 2016

(65) Prior Publication Data

US 2018/0061306 A1 Mar. 1, 2018

(30) Foreign Application Priority Data

Aug. 25, 2016 (KR) ..... 10-2016-0108607

(51) Int. Cl.
*G09G 3/20* (2006.01)

(52) U.S. Cl.
CPC ... *G09G 3/2092* (2013.01); *G09G 2300/0408* (2013.01); *G09G 2300/0426* (2013.01); *G09G 2310/0202* (2013.01); *G09G 2310/08* (2013.01)

(58) Field of Classification Search
CPC ..... G09G 3/2092; G09G 3/2096; G09G 2300/0408; G09G 2300/0426; G09G 2310/08; G09G 5/003; G02F 1/13452
See application file for complete search history.

(56) References Cited

U.S. PATENT DOCUMENTS 7,467,360 B2 * 12/2008 Eya ..... G06F 17/5068 257/48
8,304,337 B2 * 11/2012 Bathan ..... H01L 23/49838 257/784
2003/0071943 A1 4/2003 Choo et al.
2003/0227078 A1 * 12/2003 Chang ..... G02F 1/1345 257/693
2005/0194664 A1 * 9/2005 Lee ..... H01L 23/50 257/666

(Continued)

FOREIGN PATENT DOCUMENTS

CN 1360296 A 7/2002
CN 1368718 A 9/2002

(Continued)

OTHER PUBLICATIONS

Popov et al., Speed and Improve PCB Routing, Dec. 5, 2013, EDN Network, p. 3. https://www.edn.com/design/pc-board/4425712/Speed-and-improve-PCB-routing (Year: 2013).*

*Primary Examiner* — Kent W Chang
*Assistant Examiner* — Nathaniel P Brittingham
(74) *Attorney, Agent, or Firm* — Seed Intellectual Property Law Group LLP

(57) ABSTRACT

A display panel and a display device having the display panel are provided. The display panel includes two or more signal lines arranged in a column direction in a display area, two or more link lines arranged in a non-display area to be electrically connected to the two or more signal lines or to extend from the two or more signal lines, and two or more pads arranged in the non-display area to be electrically connected to the two or more link lines, and at least one of the two or more link lines extends in a diagonal direction in a pad area in which the two or more pads are located. Accordingly, it is possible to decrease the size of the non-display area to enable a narrow bezel design.

17 Claims, 19 Drawing Sheets

(56) References Cited

U.S. PATENT DOCUMENTS

2006/0139255 A1 6/2006 Kim et al.
2006/0170447 A1* 8/2006 Maeda ..... G09G 3/006 324/760.01
2008/0048948 A1* 2/2008 Koh ..... G09G 3/3208 345/80
2009/0262292 A1* 10/2009 Lee ..... G02F 1/1345 349/149
2009/0294771 A1* 12/2009 Kim ..... G02F 1/136204 257/59
2010/0006838 A1* 1/2010 Yoshida ..... G09G 3/006 257/48
2010/0045586 A1* 2/2010 Kim ..... G02F 1/136213 345/98
2010/0079717 A1* 4/2010 Park ..... G02F 1/1345 349/152
2010/0110057 A1* 5/2010 Lee ..... G02F 1/134309 345/211
2011/0024919 A1* 2/2011 Kang ..... H01L 23/13 257/782
2012/0127412 A1* 5/2012 Lee ..... G02F 1/1345 349/139
2012/0212684 A1* 8/2012 Ochiai ..... G02F 1/13458 348/790
2013/0099383 A1* 4/2013 Meyer-Berg ..... H01L 23/5226 257/772
2013/0141317 A1* 6/2013 Choi ..... G09G 3/20 345/84
2013/0265072 A1* 10/2013 Kim ..... G09G 3/006 324/754.01
2014/0022148 A1* 1/2014 Kim ..... G09G 5/003 345/55
2014/0022230 A1* 1/2014 Hasumi ..... G09G 3/3696 345/212
2015/0187803 A1* 7/2015 Moh ..... H01L 27/124 257/43
2015/0269911 A1* 9/2015 Choi ..... H01L 23/50 345/205
2016/0011108 A1* 1/2016 Jeon ..... G09G 3/3648 356/445
2016/0027398 A1* 1/2016 Kim ..... G09G 5/00 345/212
2016/0035307 A1* 2/2016 Jeon ..... H01L 27/124 345/211
2016/0064364 A1* 3/2016 Shin ..... G02F 1/1309 257/88
2016/0126303 A1* 5/2016 Kwon ..... G09G 3/3233 257/40
2016/0188114 A1* 6/2016 Kim ..... G06F 3/044 345/174
2016/0211207 A1* 7/2016 Lin ..... H01L 23/564
2016/0291640 A1* 10/2016 Seo ..... G09G 3/00
2017/0193872 A1* 7/2017 Lee ..... G09G 3/006
2017/0309651 A1* 10/2017 Kim ..... G02F 1/1345
2018/0059449 A1* 3/2018 Kim ..... G02F 1/1309
2018/0061306 A1* 3/2018 Eom ..... G09G 3/2092

FOREIGN PATENT DOCUMENTS

CN 103839488 A 6/2014
CN 103903557 A 7/2014
DE 10 2013 113 919 A1 6/2014
TW 200916928 A 4/2009

* cited by examiner

DISPLAY PANEL AND DISPLAY DEVICE

CROSS-REFERENCE TO RELATED APPLICATION

This application claims priority from Korean Patent Application No. 10-2016-0108607, filed on Aug. 25, 2016, which is hereby incorporated by reference for all purposes as if fully set forth herein.

BACKGROUND

Technical Field

The present disclosure relates to a display panel and a display device.

Description of the Related Art

With advancement of information-oriented societies, various kinds of demands for display devices for displaying images have increased, and various types of display devices have been used, such as a liquid crystal display device (LCD), a plasma display panel (PDP), and an organic light-emitting display device (OLED).

Such a display device includes a display panel in which plural sub pixels defined by plural data lines and plural gate lines are arranged, and a driver that drives the display panel.

The display panel includes a display area in which an image is displayed and a non-display area in which an image is not displayed.

In the non-display area of the display panel, plural link lines and pads are disposed to electrically connect signal lines, such as plural data lines and plural gate lines, to the driver.

Accordingly, the size of the non-display area of the display panel increases. As a result, the size of a bezel increases.

Therefore, a signal transmission structure in the related art has a limit in design of a narrow bezel design.

BRIEF SUMMARY

An object of the present embodiments is to provide a display panel and a display device that have a signal transmission structure enabling a narrow bezel design.

Another object of the present embodiments is to provide a display panel and a display device that have a small non-display area.

Another object of the present embodiments is to provide a display panel and a display device that can reduce a size of a space between a display area in which signal lines are arranged and a pad area in which pads are arranged.

According to an aspect of the present disclosure, there is provided a display device including: a display panel in which two or more signal lines are arranged in a column direction in a display area, two or more link lines electrically connected to the two or more signal lines or extending from the two or more signal lines are arranged in a non-display area, and two or more pads electrically connected to the two or more link lines are arranged; and a driver integrated circuit that is electrically connected to the two or more pads.

In the display device, each of the two or more pads may include an upside portion and a downside portion. The upside portion may be an upper half of the pad, and the downside portion may be a lower half of the pad.

The downside portion of each of the two or more pads may be closer to the display area than the upside portion.

The upside portion of each of the one or more first pads closest to the display area among the two or more pads may be electrically connected to a corresponding first link line.

The first link line electrically connected to the upside portion of each of the one or more first pads may extend in a diagonal direction in a pad area in which the two or more pads are located.

According to another aspect of the present disclosure, there is provided a display device including: a display panel in which two or more signal lines are arranged in a column direction in a display area, two or more link lines electrically connected to the two or more signal lines or extending from the two or more signal lines are arranged in a non-display area, and two or more pads electrically connected to the two or more link lines are arranged; and a driver integrated circuit that is electrically connected to the two or more pads.

In the display device, at least one of the two or more link lines may extend in a diagonal direction in a pad area in which the two or more pads are located.

According to another aspect of the present disclosure, there is provided a display device including: a display panel in which two or more signal lines are arranged in a column direction in a display area, two or more link lines electrically connected to the two or more signal lines or extending from the two or more signal lines are arranged in a non-display area, and two or more pads electrically connected to the two or more link lines are arranged; and a driver integrated circuit that is electrically connected to the two or more pads.

In the display device, at least one of the two or more link lines may overlap at least one pad in a pad area in which the two or more pads are located.

According to another aspect of the present disclosure, there is provided a display panel including: two or more signal lines that are arranged in a column direction in a display area; two or more link lines that are arranged to be electrically connected to the two or more signal lines or to extend from the two or more signal lines in a non-display area; and two or more pads that are electrically connected to the two or more link lines in the non-display area.

In the display panel, each of the two or more pads may include an upside portion and a downside portion.

The downside portion of each of the two or more pads may be closer to the display area than the upside portion.

The upside portion of each of the one or more first pads closest to the display area among the two or more pads may be electrically connected to a corresponding first link line.

The first link line electrically connected to the upside portion of each of the one or more first pads may extend in a diagonal direction in a pad area in which the two or more pads are located.

According to another aspect of the present disclosure, there is provided a display panel including: two or more signal lines that are arranged in a column direction in a display area; two or more link lines that are arranged to be electrically connected to the two or more signal lines or to extend from the two or more signal lines in a non-display area; and two or more pads that are electrically connected to the two or more link lines in the non-display area.

In the display panel, at least one of the two or more link lines may extend in a diagonal direction in a pad area in which the two or more pads are located.

According to another aspect of the present disclosure, there is provided a display panel including: two or more signal lines that are arranged in a column direction in a display area; two or more link lines that are arranged to be electrically connected to the two or more signal lines or to extend from the two or more signal lines in a non-display area; and two or more pads that are electrically connected to the two or more link lines in the non-display area.

In the display panel, at least one of the two or more link lines may overlap at least one pad in a pad area in which the two or more pads are located.

According to the above-mentioned embodiments, it is possible to provide a display panel and a display device that have a signal transmission structure enabling a narrow bezel design.

According to the present embodiments, it is possible to provide a display panel and a display device that have a small non-display area.

According to the present embodiments, it is possible to provide a display panel and a display device that can reduce a size of a space between a display area in which signal lines are arranged and a pad area in which pads are arranged.

BRIEF DESCRIPTION OF THE SEVERAL VIEWS OF THE DRAWINGS

The above and other objects, features and advantages of the present disclosure will be more apparent from the following detailed description taken in conjunction with the accompanying drawings, in which.

DETAILED DESCRIPTION

Figure 1:
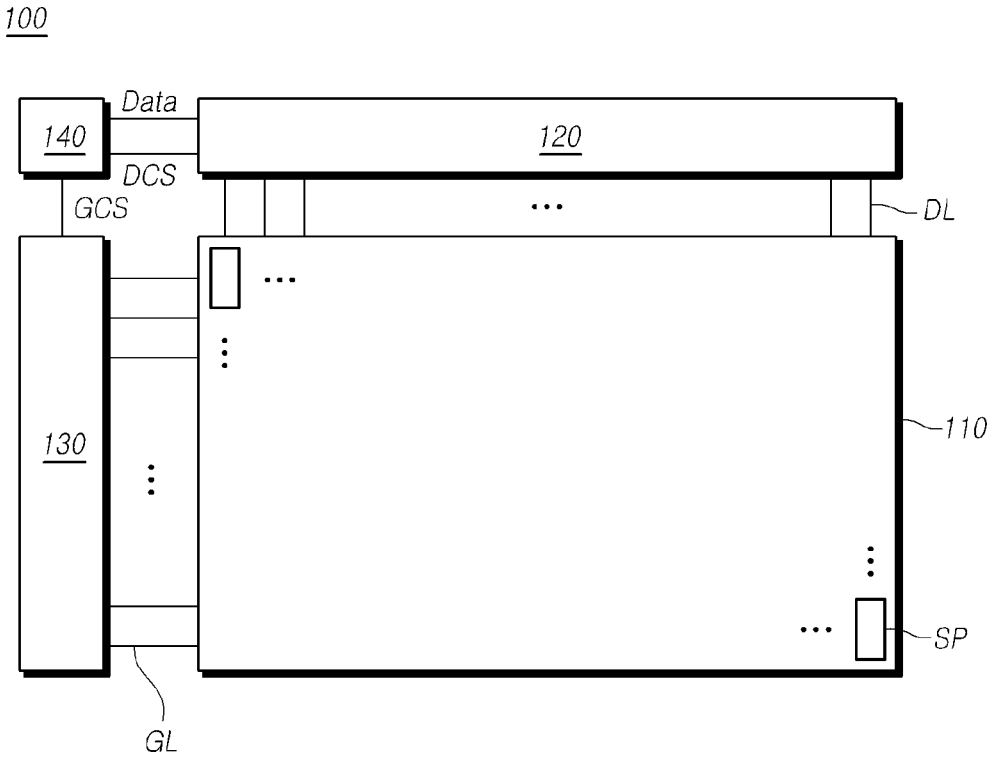
FIG. 1 is a diagram illustrating a system configuration of a display device according to one or more embodiments of the present disclosure.

Hereinafter, exemplary embodiments of the present disclosure will be described in detail with reference to the accompanying illustrative drawings. In referencing elements of the drawings by reference numerals, the same elements will be referenced by the same reference numerals although the elements are illustrated in different drawings. In the following description of the present disclosure, detailed description of known functions and configurations incorporated herein will be omitted when it may make the subject matter of the present disclosure rather unclear.

Terms, such as first, second, A, B, (a), or (b) may be used herein to describe elements of the present disclosure. Each of the terms is not used to define essence, order, sequence, or number of an element, but is used merely to distinguish the corresponding element from another element. When it is mentioned that an element is "connected" or "coupled" to another element, it should be interpreted that another element may be interposed between the elements or the elements may be "connected" or "coupled" to each other via another element, as well as that one element is directly connected or coupled to another element.

FIG. 1 is a diagram illustrating a system configuration of a display device according to one or more embodiments of the present disclosure.

Referring to FIG. 1, a display device 100 according to the present embodiments includes a display panel 110 in which plural data lines DL and plural gate lines GL are arranged, and in which plural sub pixels SP defined by the data lines DL and the gate lines GL are arranged. The display device 100 further includes a data driver 120 that drives the data lines DL, a gate driver 130 that drives the gate lines GL, and a controller 140 that controls the data driver 120 and the gate driver 130.

The controller 140 supplies various control signals to the data driver 120 and the gate driver 130 to control the data driver 120 and the gate driver 130.

The controller 140 starts scanning at a timing of each frame, switches externally input image data to a data signal format which is used by the data driver 120, outputs the switched image data, and controls data driving at an appropriate timing corresponding to the scanning.

The controller 140 may be a timing controller which is used in normal display techniques or may be a controller that performs control functions including a timing controller function.

The controller 140 may be embodied by a component other than the data driver 120 or may be embodied as an integrated circuit along with the data driver 120.

The data driver 120 drives the plural data lines DL by supplying a data voltage to the data lines DL. Here, the data driver 120 is also referred to as a "source driver."

The data driver 120 includes at least one source driver integrated circuit (IC) and can drive plural data lines.

Each source driver IC includes a shift register, a latch circuit, a digital-to-analog converter (DAC), and an output buffer.

Each source driver IC may further include an analog-to-digital converter (ADC) in some cases.

The gate driver 130 sequentially drives the plural gate lines GL by sequentially supplying a scan signal to the gate lines GL. Here, the gate driver 130 is also referred to as a "scan driver."

The gate driver 130 includes at least one gate driver integrated circuit (IC).

Each gate driver IC includes a shift register and a level shifter.

The gate driver 130 sequentially supplies a scan signal of an ON voltage or an OFF voltage to the gate lines GL under the control of the controller 140.

When a specific gate line is selected by the gate driver 130, the data driver 120 converts image data received from the controller 140 into an analog data voltage and supplies the analog data voltage to the data lines DL.

As illustrated in FIG. 1, the data driver 120 may be located on only one side (for example, an upper side or a lower side) of the display panel 110, or may be located on both sides (for example, the upper side and the lower side) of the display panel 110 depending on a driving method, a panel design method, or the like.

As illustrated in FIG. 1, the gate driver 130 may be located on only one side (for example, a right side or a left side) of the display panel 110, or may be located on both sides (for example, the right side and the left side) of the display panel 110 depending on a driving method, a panel design method, or the like.

The controller 140 receives various timing signals including a vertical synchronization signal Vsync, a horizontal synchronization signal Hsync, an input data enable (DE) signal, and a clock signal CLK along with input image data from the outside (for example, a host system).

In order to control the data driver 120 and the gate driver 130, the controller 140 receives the timing signals such as a vertical synchronization signal Vsync, a horizontal synchronization signal Hsync, an input DE signal, and a clock signal and generates and outputs various control signals to the data driver 120 and the gate driver 130.

For example, the controller 140 outputs various gate control signals GCS) including a gate start pulse (GSP), a gate shift clock (GSC), and a gate output enable (GOE) signal to control the gate driver 130.

Here, the gate start pulse (GSP) controls an operation start timing of one or more gate driver ICs of the gate driver 130. The gate shift clock (GSC) is a clock signal which is input commonly to the one or more gate driver ICs and controls a shift timing of a scan signal (a gate pulse). The gate output enable (GOE) signal designates timing information of the one or more gate driver ICs.

The controller 140 outputs various data control signals (DCS) including a source start pulse (SSP), a source sampling clock (SSC), and a source output enable (SOE) signal to control the data driver 120.

Here, the source start pulse (SSP) controls a data sampling start timing of one or more source driver ICs of the data driver 120. The source sampling clock (SSC) is a clock signal for controlling a data sampling timing of each source driver IC. The source output enable (SOE) signal controls the output timing of the data driver 120.

The data driver 120 includes at least one source driver IC (SDIC) and can drive plural data lines.

Each source driver IC may be connected to a bonding pad (also simply referred to as a "pad") of the display panel 110 in a tape automated bonding (TAB) type or in a chip on glass (COG) type, may be directly mounted on the display panel 110, or may be integrated and arranged on the display panel 110 in some cases.

Each source driver IC may be embodied in a chip on film (COF) type in which a circuit is mounted on a film electrically connected to a bonding pad of the display panel 110.

The gate driver 130 may include at least one gate driver IC (GDIC).

Each gate driver IC may be connected to a bonding pad of the display panel 110 in a TAB type or in a COG type, may be directly mounted on the display panel 110 in a gate in panel (GIP) type, or may be integrated and arranged on the display panel 110 in some cases.

Each gate driver IC may be embodied in a COF type in which a circuit is mounted on a film electrically connected to a bonding pad of the display panel 110.

The display device 100 according to the present embodiments may include at least one source printed circuit board for circuit connection of at least one source driver IC, and a control printed circuit board for mounting control components and various electric units thereon.

At least one source driver IC may be directly mounted on the at least one source printed circuit board, or a film on which at least one source driver IC is mounted may be connected thereto.

The controller 140 that controls the operations of the data driver 120 and the gate driver 130, the display panel 110, a power supply controller that supplies various voltages or currents to the data driver 120 and the gate driver 130 or controls various voltages or currents to be supplied, and the like may be mounted on the control printed circuit board.

The at least one source printed circuit board and the control printed circuit board may be connected to each other via at least one connection member.

Here, the connection member may be a flexible printed circuit (FPC), a flexible flat cable (FFC), or the like.

The at least one source printed circuit board and the control printed circuit board may be incorporated into a single printed circuit board.

The controller 140 may be incorporated into the source driver IC.

Figure 2:
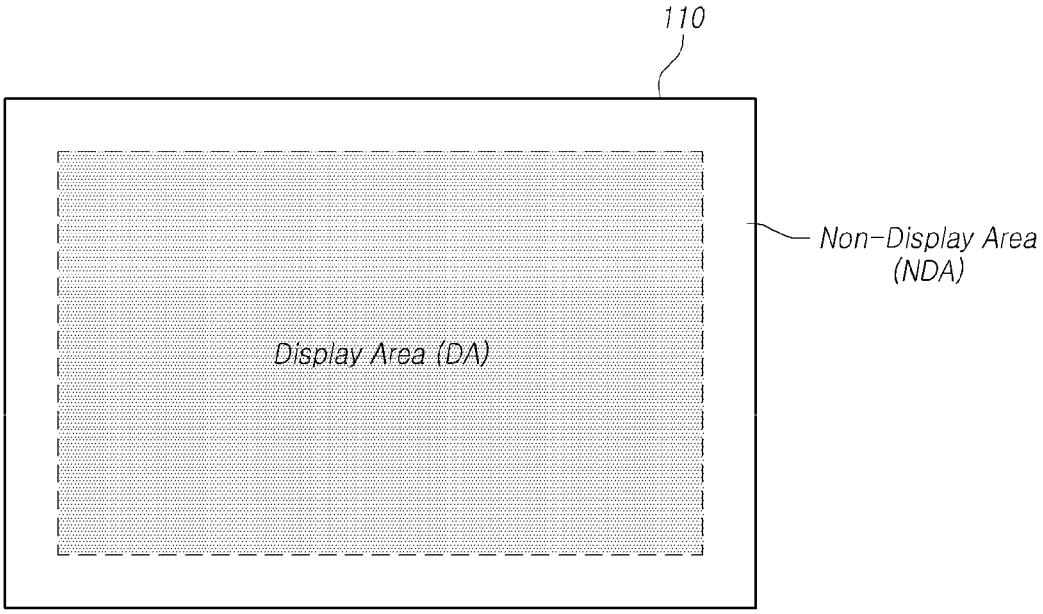
FIG. 2 is a plan view of a display panel according to embodiments of the present disclosure.

FIG. 2 is a plan view of the display panel 110 according to one or more embodiments of the present disclosure.

Referring to FIG. 2, the display panel 110 according to the present embodiments includes a display area DA in which an image is displayed and a non-display area NDA in which an image is not displayed.

The display area DA is also referred to as an active area and the non-display area NDA is also referred to as a non-active area.

Sub pixels which are defined by the data lines DL and the gate lines GL may be arranged in a matrix in the display area DA.

Circuit elements such as at least one transistor may be arranged in each sub pixel SP.

The type and number of circuit elements in each sub pixel SP can vary depending on a panel type.

The display panel 110 according to the present embodiments may be any of a variety of types of display panels, such as a liquid crystal display panel and an organic light-emitting display panel.

Figure 3:
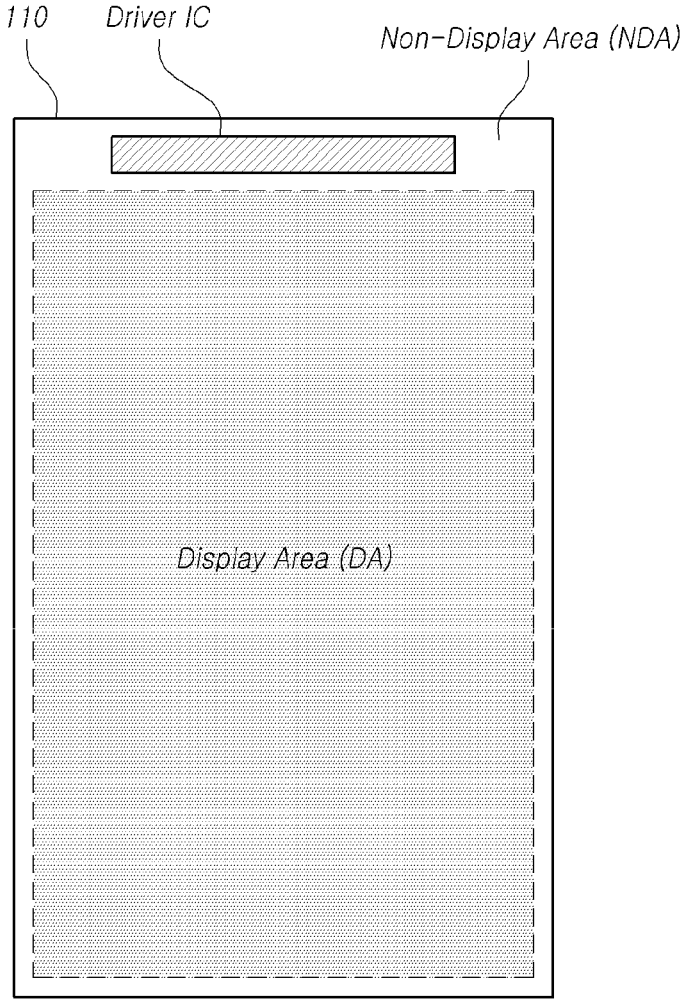
FIG. 3 is a diagram illustrating a driver integrated circuit which is electrically connected to a display panel in a COG type according to embodiments of the present disclosure.
Figure 4:
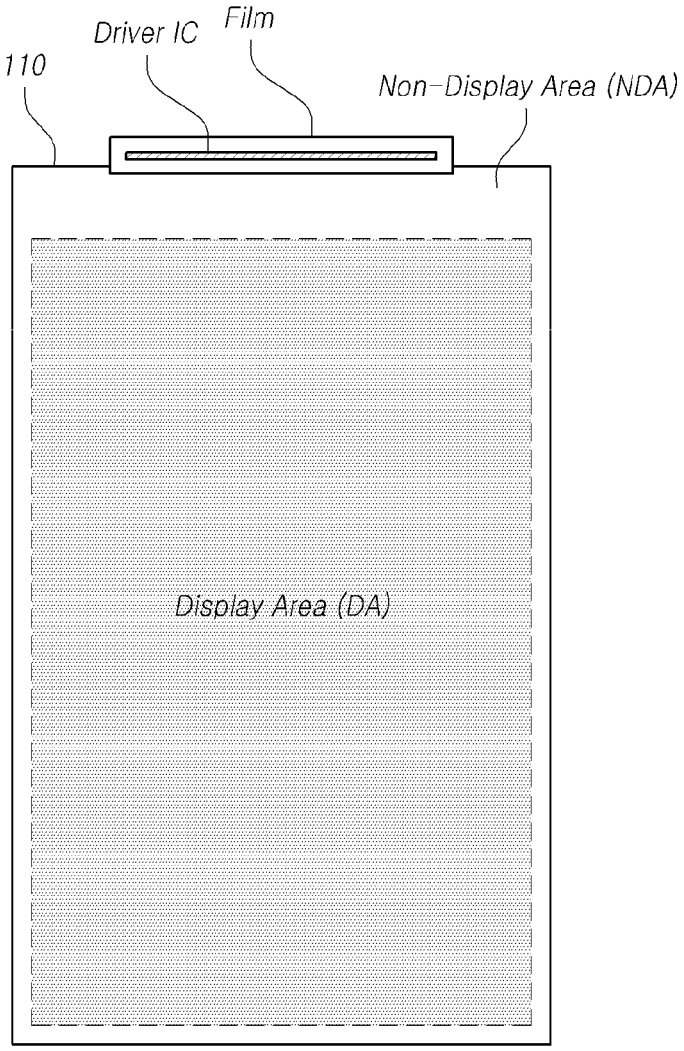
FIG. 4 is a diagram illustrating a driver integrated circuit which is electrically connected to a display panel in a COF type according to embodiments of the present disclosure.

FIG. 3 is a diagram illustrating a driver IC which is electrically connected to the display panel 110 in a COG type according to one or more embodiments, and FIG. 4 is a diagram illustrating a driver IC which is electrically connected to the display panel 110 in a COG type according to one or more embodiments.

Referring to FIG. 3, the driver IC can be mounted in a COG type in the non-display area NDA of the display panel 110.

Referring to FIG. 4, the driver IC may be mounted in a COF type in the non-display area NDA of the display panel 110.

Referring to FIGS. 3 and 4, a pad area for direct or indirect electrical connection to the driver IC is included in the non-display area NDA of the display panel 110.

Referring to FIG. 3, the driver IC is electrically connected to pads (bonding pads) in the pad area of the non-display area NDA of the display panel 110.

Referring to FIG. 4, the driver IC is mounted on a film in which lines for electrical signal transmission are formed and pads on the film are electrically connected to pads (bonding pads) in the pad area of the non-display area NDA of the display panel 110.

The driver IC illustrated in FIGS. 3 and 4 may be a source driver IC for driving the data lines DL as signal lines, a gate driver IC for driving the gate lines GL as signal lines, or an IC in which the source driver IC and the gate driver IC are combined.

Figure 5:
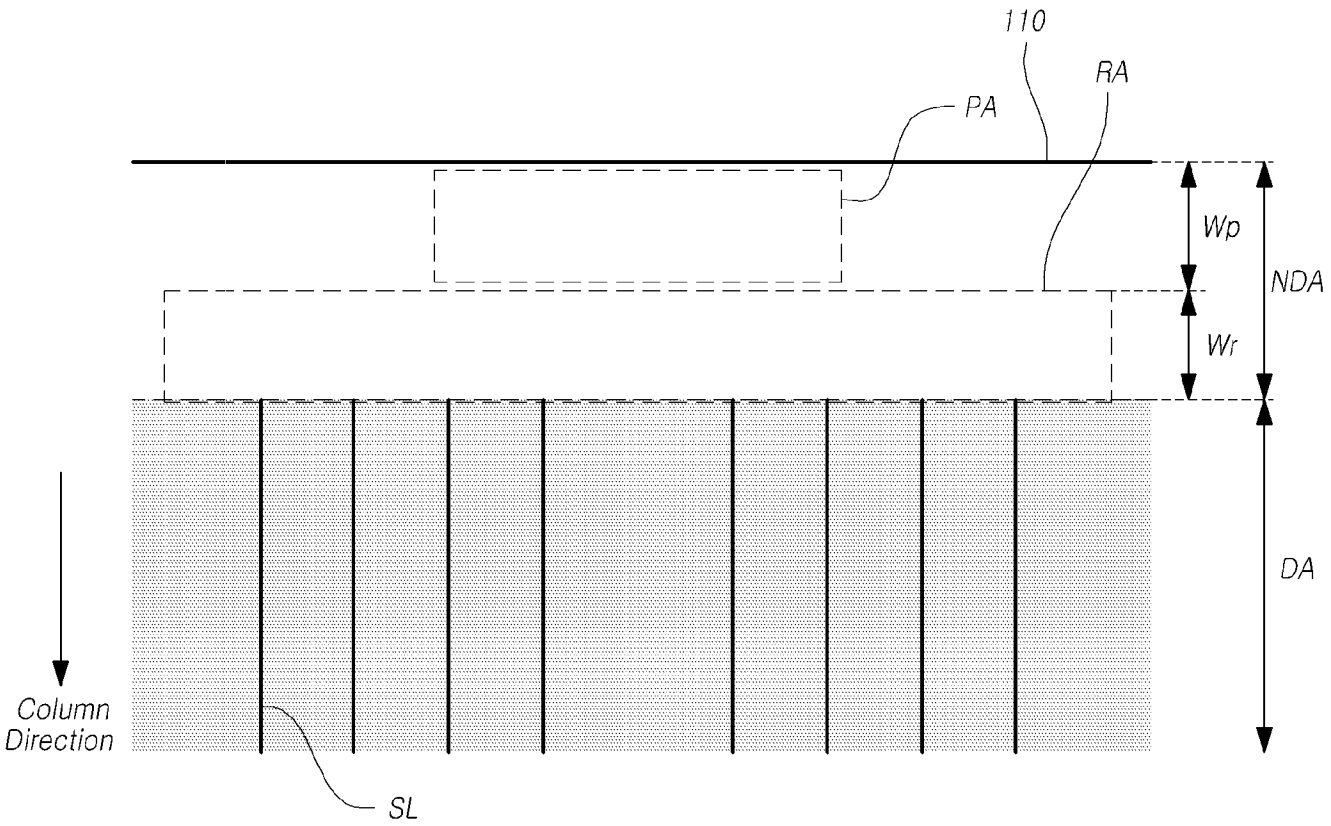
FIG. 5 is a diagram illustrating a display area and a non-display area of a display panel according to embodiments of the present disclosure and a pad area and a routing area included in the non-display area.

FIG. 5 is a diagram illustrating a display area DA and a non-display area NDA of the display panel 110 according to one or more embodiments, and a pad area PA and a routing area RA which are included in the non-display area NDA.

Referring to FIG. 5, the non-display area NDA may have a signal transmission structure for transmitting a signal output from the driver IC to two or more signal lines SL arranged in the display area DA.

More specifically, the non-display area NDA includes a pad area PA in which two or more pads for electrical connection of the display panel 110 to a driver IC or a film on which the driver IC is mounted are present and a routing area RA (which is also referred to as a link area) in which two or more link lines for electrical connection of two or more signal lines SL to two or more pads.

The length in the column direction of the non-display area NDA is equal to or greater than the total length of the length in the column direction Wp of the pad area PA and the length in the column direction Wr of the routing area RA.

The length in the column direction of the non-display area NDA can be recognized as the bezel size of the display panel 110.

Referring to FIG. 5, since the length in the row direction of the driver IC (that is, the length in the row direction of the pad area PA) is smaller than the length in the row direction of the display panel 110, the link lines arranged in the routing area RA do not correspond to the signal lines in the column direction but correspond to the signal lines in a diagonal direction.

Accordingly, the link lines arranged in the routing area RA should extend in the diagonal direction. Here, each link line may be a linear or straight line extending in a diagonal direction or may be a curved line extending in a diagonal direction.

Referring to FIG. 5, since two or more link lines for electrical connection of two or more pads to two or more signal lines SL should be arranged to extend in the diagonal direction, the length in the column direction Wr of the routing area RA increases.

Accordingly, the length in the column direction of the non-display area, that is, the bezel size of the display panel 110, increases.

As described above, the increase in the bezel size is attributed to the structure in which the link lines are arranged to extend in the diagonal direction in the non-display area NDA.

The increase in the bezel size can further progress due to the structure in which the pads and the link lines are connected (bonded) to each other. This will be described below with reference to FIG. 6.

Figure 6:
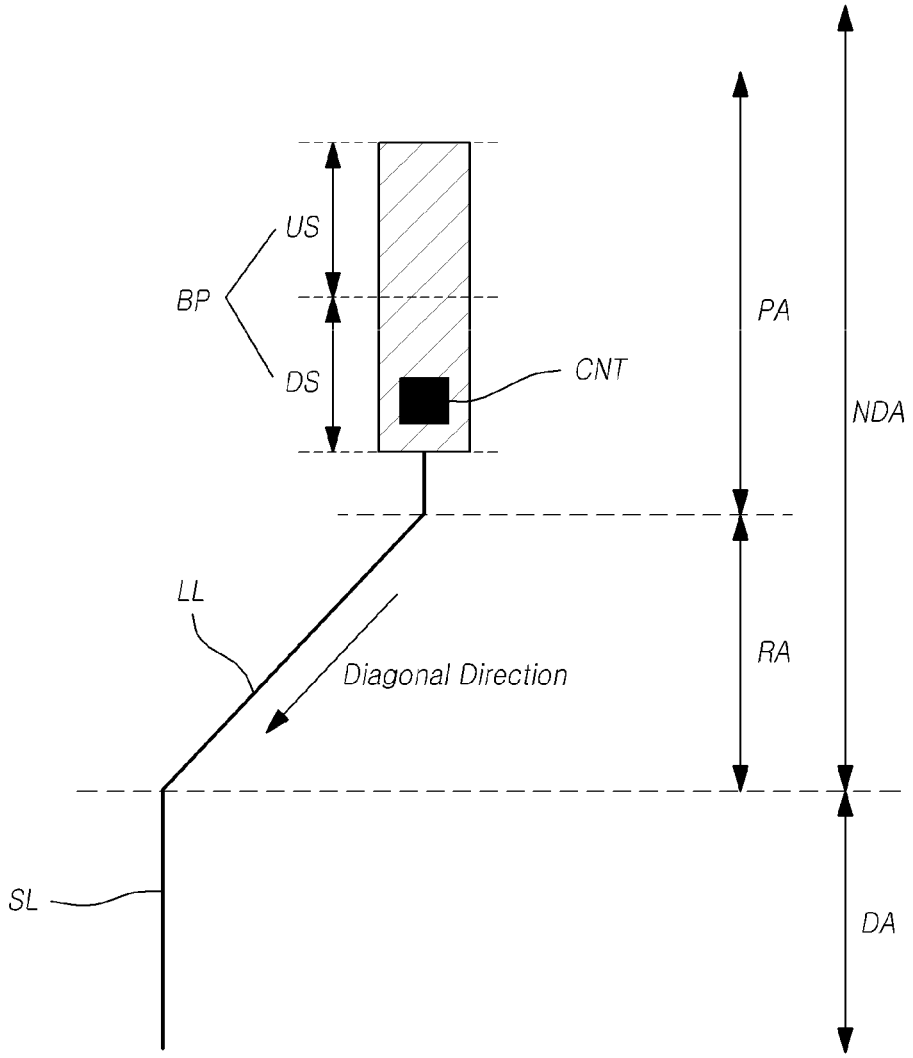
FIG. 6 is a diagram illustrating a first connection structure of a link line and a pad in a display panel according to embodiments of the present disclosure.

FIG. 6 is a diagram illustrating a first connection structure of a link line LL and a pad BP in the display panel 110 according to the present embodiments.

Referring to FIG. 6, a pad BP can be divided into two portions (an upside portion and a downside portion) with respect to the center of the pad BP.

Among the two portions into which the pad BP is divided with respect to the center of the pad BP, the portion farther from the display area DA (that is, the portion closer to the edge of the display panel 110) is referred to as an upside portion US, and the portion closer to the display area DA (that is, the portion farther from the edge of the display panel 110) is referred to as a downside portion DS. That is, each of the pads BP have an upper half (which may be referred to herein as the upside portion US) and a lower half (which may be referred to herein as the downside portion DS), and the upper half is defined herein as being the half of the pad BP that is farther from the display area DA, while the lower half is defined herein as being the half of the pad BP that is closer to the display area DA.

The link line LL connected to the signal line SL or the link line LL extending from the signal line SL to the non-display area NDA can be connected to the downside portion DS of the pad BP via a contact hole CNT.

In this way, due to the first connection structure in which each link line LL is connected (e.g., bonded) to the downside portion DS of the corresponding pad BP, the link lines LL extend in the diagonal direction in the routing area RA, not in the pad area PA.

Regarding extension of each link line LL in the diagonal direction, each link line LL extends straight in the diagonal direction as illustrated in FIG. 6, or may extend as a bent line or a curved line extending generally in the diagonal direction.

As described above, since each link line LL extends in the diagonal direction in the routing area RA, not in the pad area PA, the length in the column direction Wr of the routing area RA increases and the length in the column direction of the non-display area NDA (that is, the bezel size) further increases.

The increase in the bezel size may further progress as the number of signal lines increases.

Figure 7:
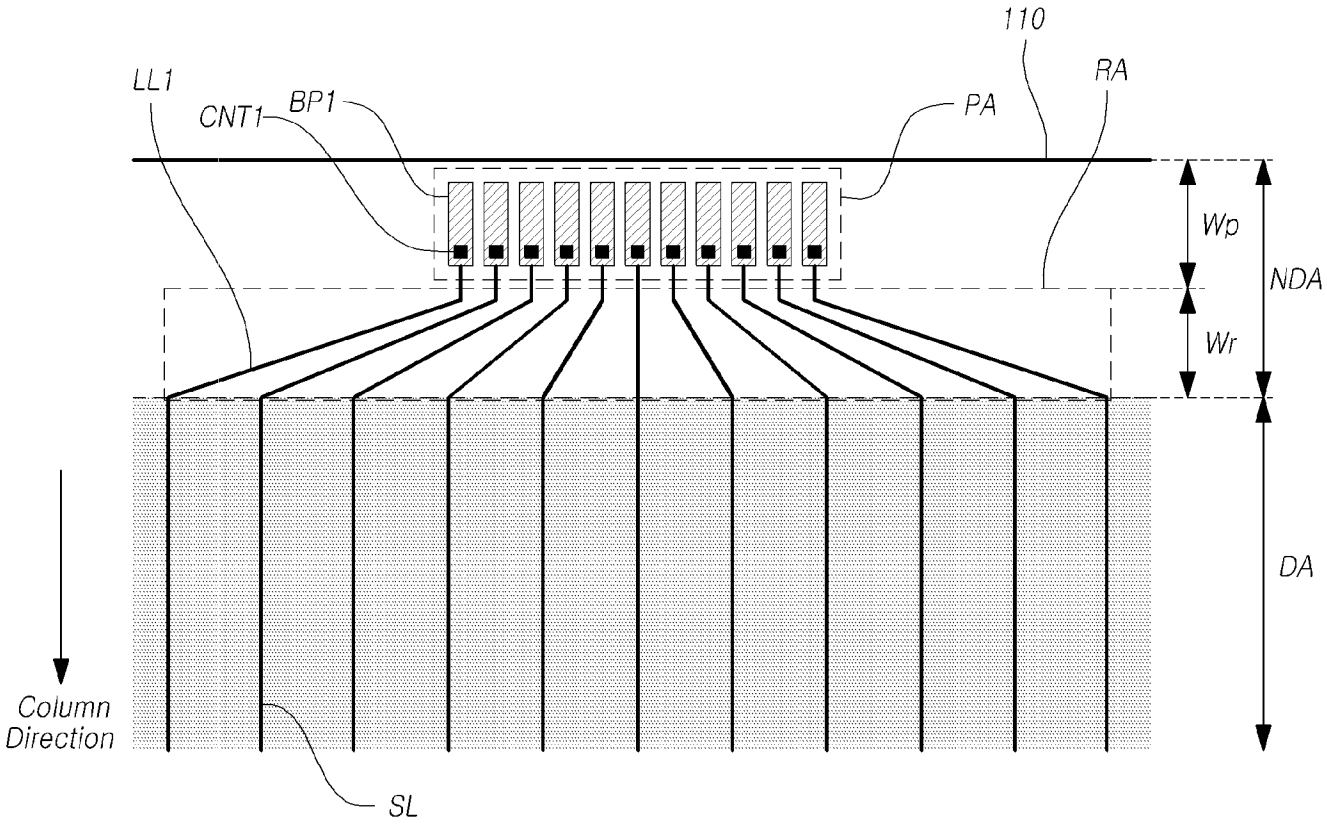
FIGS. 7 and 8 are diagrams illustrating examples in which the first connection structure of a link line and a pad is applied to a display panel according to embodiments of the present disclosure.
Figure 8:
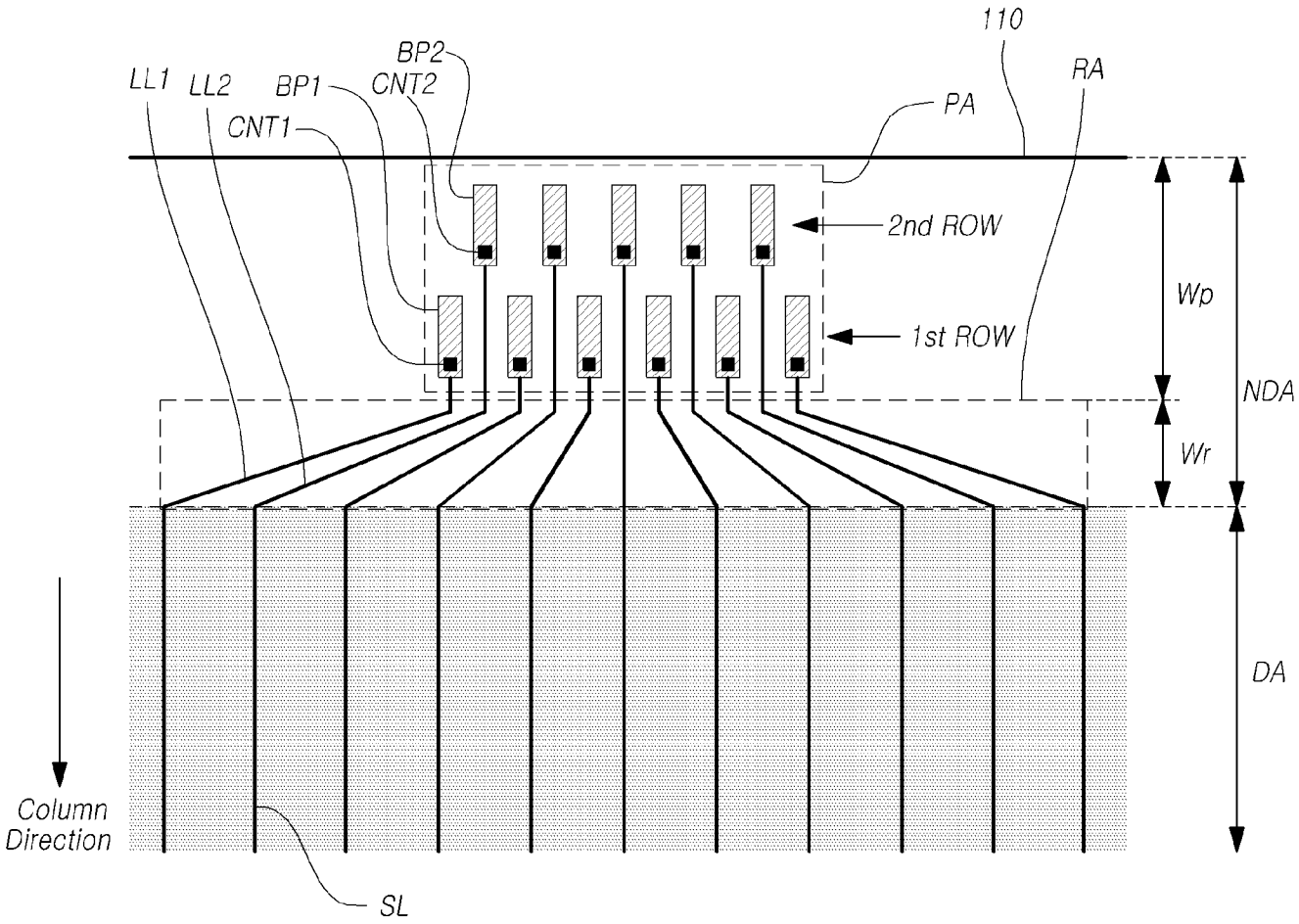

FIGS. 7 and 8 are diagrams illustrating examples in which the first connection structure of the link line LL and the pad BP illustrated in FIG. 6 is applied to the display panel 110 according to one or more embodiments.

As illustrated in FIG. 7, all the pads BP present in the pad area PA of the non-display area NDA may be arranged in one row.

On the other hand, as illustrated in FIG. 8, all the pads BP present in the pad area PA of the non-display area NDA may be divided and arranged in two rows.

In the present disclosure, one or more pads BP arranged in the first row may be referred to as one or more first pads BP1, and one or more link lines LL connected thereto may be referred to as one or more first link lines LL1.

One or more first pads BP1 arranged in the first row and one or more first link lines LL1 corresponding thereto can be connected via one or more first contact holes CNT1.

One or more pads BP arranged in the second row are referred to as one or more second pads BP2, and one or more link lines LL connected thereto are referred to as one or more second link lines LL2.

One or more second pads BP2 arranged in the second row and one or more second link lines LL2 corresponding thereto can be connected via one or more second contact holes CNT2.

In the present disclosure, the first row is a row closest to the display area DA and the second row is a row adjacent thereto in a direction in which the distance from the display area DA increases.

Referring to FIG. 7, since the first link line LL1 extends in the diagonal direction in the routing area RA, not in the pad area PA, the length in the column direction Wr of the routing area RA further increases and the length in the column direction of the non-display area NDA (that is, the bezel size) further increases.

Referring to FIG. 8, since the first link line LL1 and the second link line LL2 extend in the diagonal direction in the routing area RA, not in the pad area PA, the length in the column direction Wr of the routing area RA further increases and the length in the column direction of the non-display area NDA (that is, the bezel size) further increases.

The increase in the bezel size may further progress as the number of signal lines increases.

Figure 9:
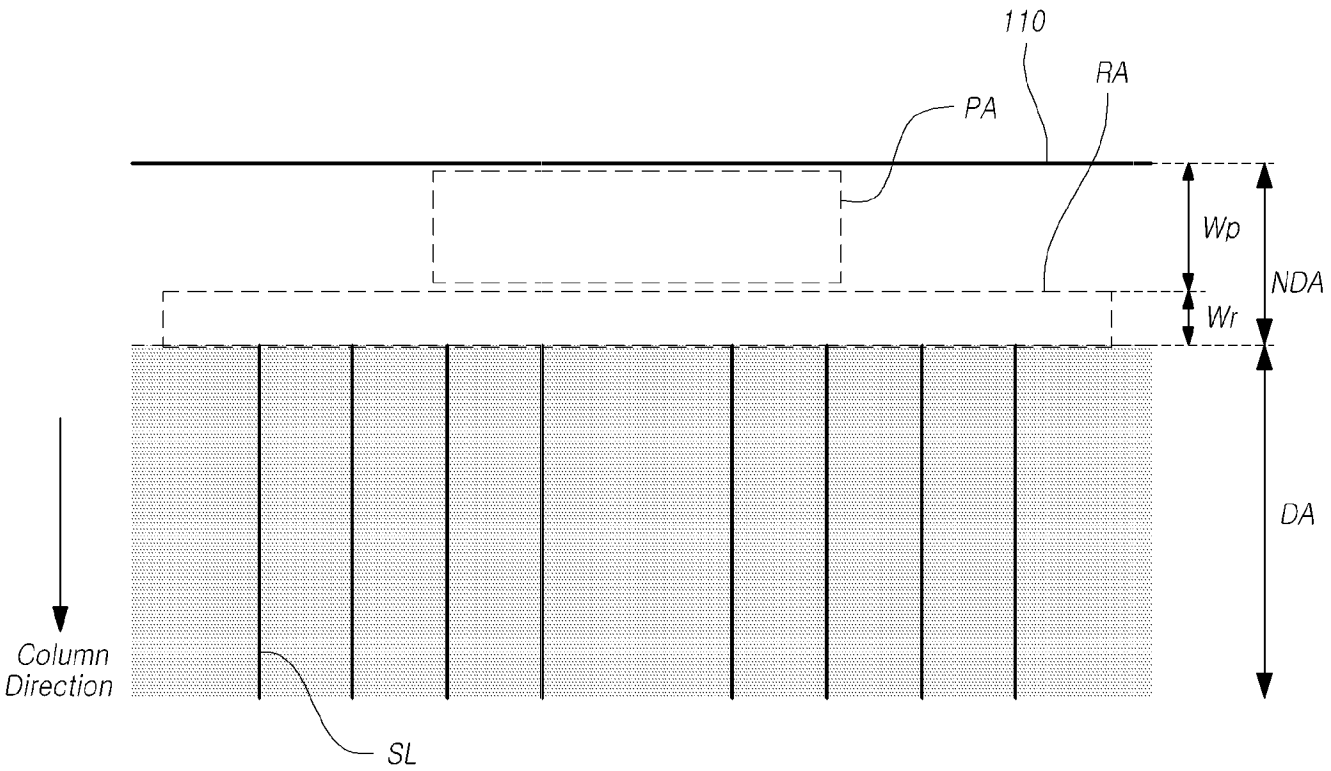
FIG. 9 is a diagram illustrating an example in which a bezel area decreases by decreasing the routing area of the non-display area of a display panel according to embodiments of the present disclosure.

FIG. 9 is a diagram illustrating an example in which the bezel is reduced by decreasing the routing area RA of the non-display area NDA of the display panel 110 according to one or more embodiments.

Referring to FIG. 9, in the display panel 110 according to one or more embodiments, it is possible to remove the routing area RA or to greatly reduce the length in the column direction Wr of the routing area RA using a new connection structure (a second connection structure) of the link line LL and the pad BP.

Accordingly, it is possible to decrease the length in the column direction of the non-display area NDA and thus to decrease the bezel size.

The new connection structure (the second connection structure) of the link line LL and the pad BP which enables a decrease in the bezel size will be described below.

Figure 10:
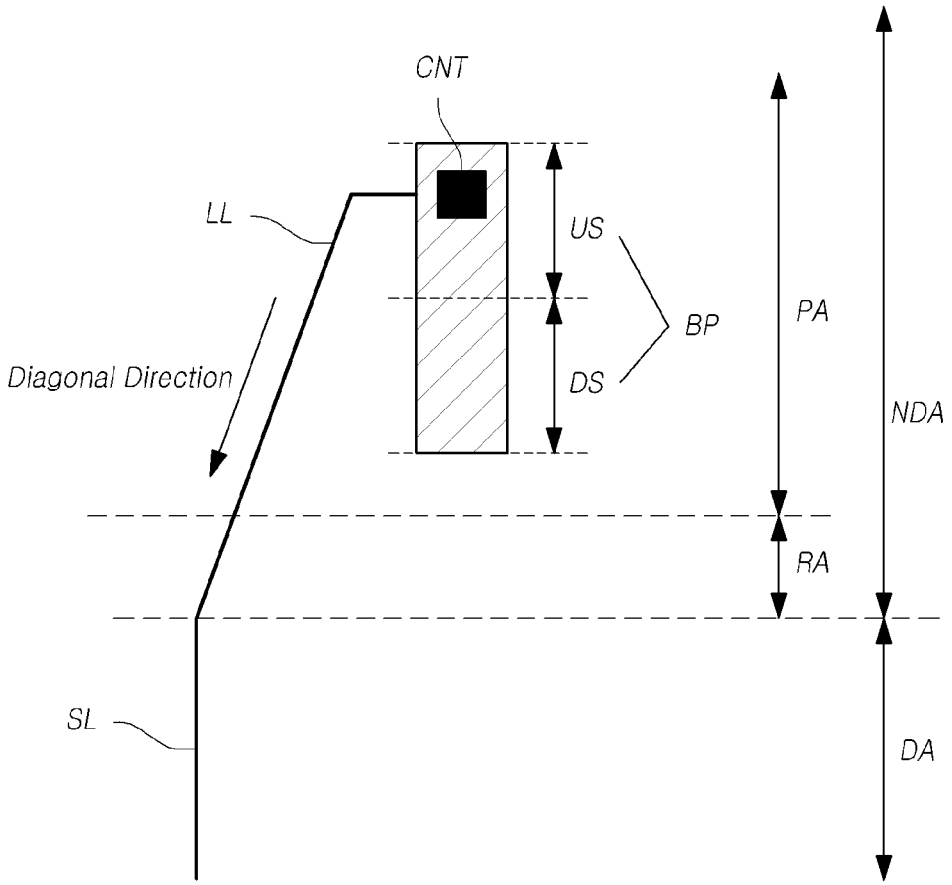
FIG. 10 is a diagram illustrating a second connection structure of a link line and a pad for decreasing a bezel area of a display panel according to embodiments of the present disclosure.

FIG. 10 is a diagram illustrating the second connection structure of the link line LL and the pad BP for reducing the bezel of the display panel 110 according to one or more embodiments.

In the display panel 110 according to the present embodiments, two or more signal lines SL are arranged in the column direction in the display area DA, two or more link lines LL electrically connected to the two or more signal lines SL or extending from the two or more signal lines SL are arranged in the non-display area NDA, and two or more pads BP electrically connected to the two or more link lines LL are arranged in the non-display area NDA.

A driver IC may be electrically connected to the two or more pads BP in a COG type or a COF type. Here, the driver IC may be a source driver IC for driving the data lines DL as signal lines, a gate driver IC for driving the gate lines GL as signal lines, or an IC in which the source driver IC and the gate driver IC are combined in some cases.

Referring to FIG. 10, in the pad area PA in which two or more pads BP are arranged in the display panel 110, at least one link line LL1 of the two or more link lines LL may extend in the diagonal direction.

Referring to FIG. 10, each of the two or more pads BP is divided into an upside portion US and a downside portion DS with respect to the center of the pad BP.

The downside portion DS of each of the two or more pads BP is closer than the display area DA than the upside portion US.

The pad BP illustrated in FIG. 10 is one of one or more first pads BP1 closest to the display area DA (that is, one or more first pads arranged in the first row).

The upside portion US of each of the one or more first pads BP1 closest to the display area DA among the two or more pads BP is electrically connected to the first link line LL1 which is the corresponding link line LL via a contact hole CNT.

The first link line LL1 which is the link line LL electrically connected to the upside portion US of each of the one or more first pads BP1 closest to the display area DA may extend in the diagonal direction in the pad area PA in which the two or more pads BP are arranged.

Accordingly, it is possible to remove the routing area RA between the pad area PA of the non-display area NDA and the display area DA or to decrease the length in the column direction Wr of the routing area RA. As a result, it is possible to decrease the length in the column direction of the non-display area NDA and thus to greatly decrease the bezel size.

The above-mentioned signal lines SL may be, for example, the data lines DL.

By applying the above-mentioned second connection structure of the link line LL and the pad BP to electrically connect the driver IC to the data lines DL (which may correspond to the largest number of signal lines SL in the display panel 110), it is possible to greatly decrease the bezel size.

Figure 11:
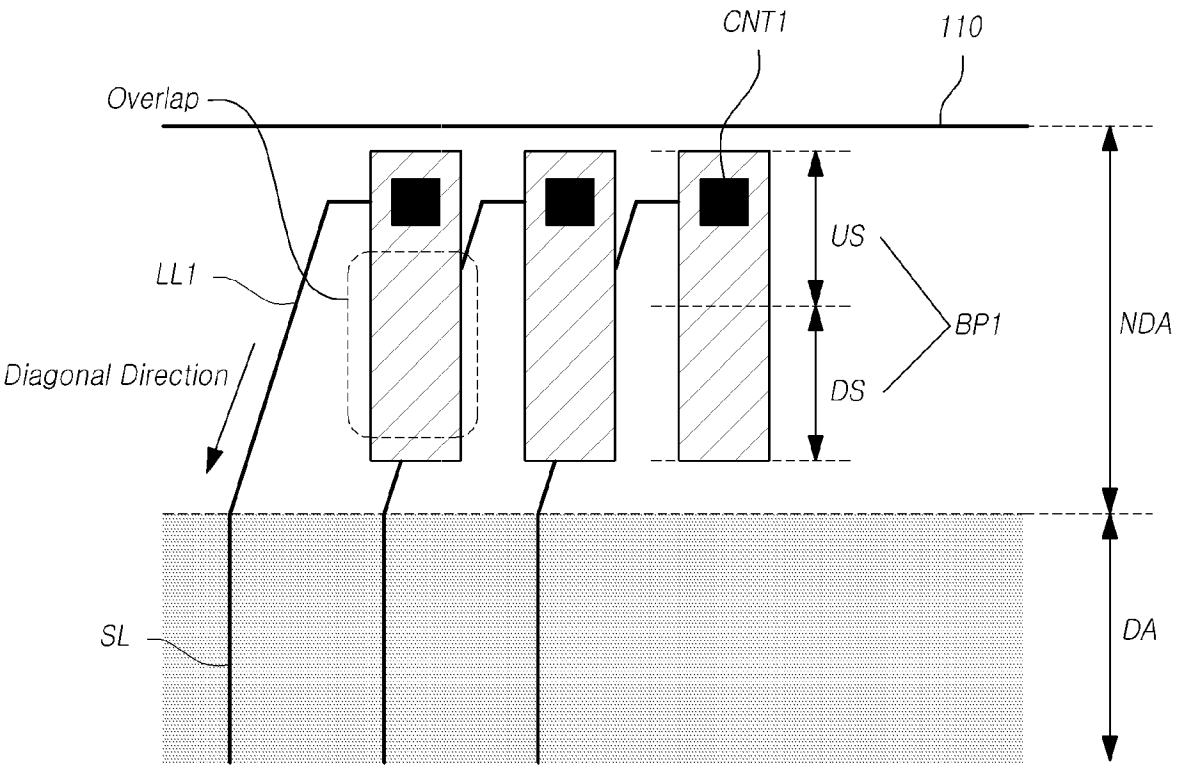
FIG. 11 is a diagram illustrating an example in which the second connection structure of a link line and a pad is applied to a display panel according to embodiments of the present disclosure.
Figure 12:
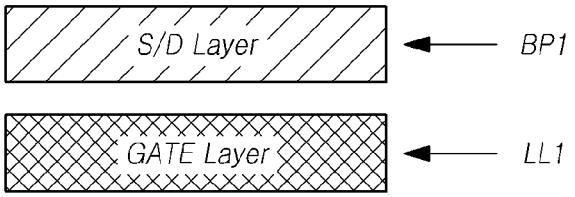
FIG. 12 is a diagram illustrating a stacked structure of a link line and a pad when the second connection structure of a link line and a pad is applied to a display panel according to embodiments of the present disclosure.

FIG. 11 is a diagram illustrating an example in which the second connection structure of the link line and the pad is applied to the display panel 110 according to embodiments of the present disclosure, and FIG. 12 is a diagram illustrating a stacked structure of the link line and the pad when the second connection structure of the link line and the pad is applied to the display panel 110 according to embodiments of the present disclosure.

FIG. 11 illustrates an example in which one pad row is present in the pad area PA of the non-display area NDA.

Referring to FIG. 11, each of two or more first pads BP1 arranged in one row includes an upside portion US and a downside portion DS, and the upside portion US of each of the two or more first pads BP1 is electrically connected to a corresponding first link line LL1 via a contact hole CNT.

The first link line LL1 electrically connected to the upside portion US of each of the two or more first pads BP1 does not extend in the diagonal direction in the space between the two or more first pads BP1 and the display area DA (that is, in the routing area RA), but extends in the diagonal direction in the pad area PA in which the two or more first pads BP1 are arranged.

Accordingly, the first link line LL1 electrically connected to the upside portion US of each of the two or more first pads BP1 may overlap or be overlapped by at least one first pad BP1.

That is, at least one link line of the two or more link lines LL and at least one pad BP may be arranged in an overlapping manner in the pad area PA in which the two or more pads BP are arranged in the non-display area NDA.

In this way, according to the overlap structure of the link line and the pad, it is possible to enhance spatial usage of the non-display area NDA and to reduce the size of the non-display area NDA.

As described above, according to the overlap structure, a pad and a link line which should not be electrically connected to each other may be short-circuited, for example, if the pad and the link line are in direct contact with one another.

Accordingly, the two or more pads BP and the two or more link lines LL may be located in different layers in one or more embodiments of the present disclosure.

An insulating layer may be interposed between the layer in which the two or more pads BP are formed and the layer in which the two or more link lines LL are formed, and the pads and the link lines corresponding to each other can be connected via the contact holes at positions at which connection is required.

For example, the layer in which the two or more pads BP are formed may be a source-drain layer (S/D layer) and the layer in which the two or more link lines LL are formed may be a gate layer, as shown in FIG. 12.

As described above, by forming the two or more pads BP and the two or more link lines LL in different layers, it is possible to realize the overlap structure in which at least one link line overlaps, or is overlapped by, at least one pad within a range in which normal signal transmission is possible.

Figure 13:
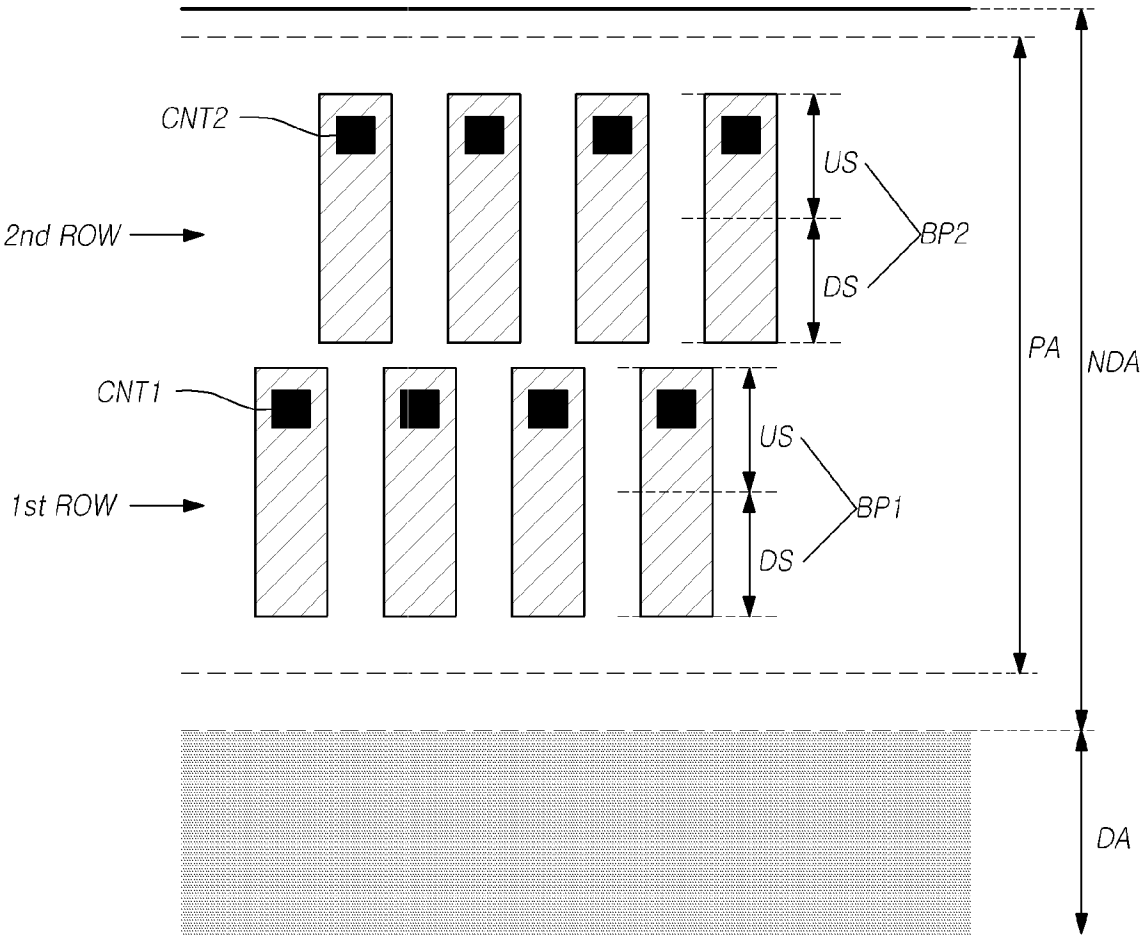
FIG. 13 is a diagram illustrating an example in which pads are arranged in two rows in the display panel according to embodiments of the present disclosure.

FIG. 13 is a diagram illustrating an example in which pads BP1 and BP2 are arranged in two rows in the display panel 110 according to the present embodiments.

Referring to FIG. 13, the two or more pads in the display panel 110 can be arranged in two or more rows.

Referring to FIG. 13, one or more first pads BP1 are arranged in the first row. Here, the first row corresponds to a row closest to the display area DA among the two or more rows.

One or more second pads BP2 are arranged in the second row adjacent to the first row.

The one or more second pads BP2 arranged in the second row can be electrically connected to the corresponding second link lines LL2.

In this way, by designing a multi-row arrangement structure in which pads are arranged in two or more rows, it is possible to prevent a short-circuit between neighboring pads and to decrease the length in the row direction of the pad area PA.

Examples of the second connection structure of a link line LL and a pad BP that enables a decrease in the length in the column direction of the routing area RA in the multi-row arrangement structure in which pads are arranged in two or more rows will be described in further detail below.

Figure 14:
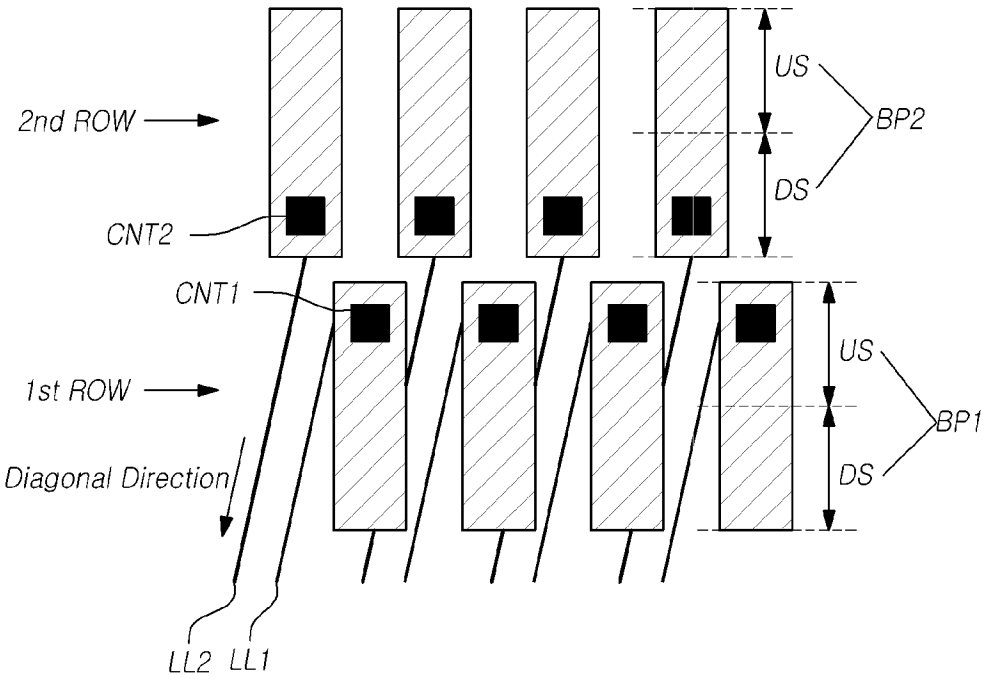
FIG. 14 is a diagram illustrating an example in which the second connection structure of a link line and a pad is applied to the case in which pads are arranged in two rows in a display panel according to embodiments of the present disclosure.

FIG. 14 is a diagram illustrating an example in which the second connection structure of a link line and a pad is applied to the case in which pads are arranged in two rows in the display panel 110 according to one or more embodiments.

Referring to FIG. 14, the upside portion US of each of one or more first pads BP1 arranged in the first row is electrically connected to the corresponding first link line LL1, but the downside portion DS of each of one or more second pads BP2 arranged in the second row is electrically connected to the corresponding second link line LL2.

The second link line LL2 electrically connected to each of the one or more second pads BP2 arranged in the second row extends in the diagonal area in a preceding pad area PA, not in the space between the pad area PA and the display area DA.

In this way, in the multi-row arrangement structure, by connecting the second link line LL2 to the downside portion DS of the second pad BP2 in the second row unlike the first row, it is possible to prevent the second link line LL2 from extending farther in the row direction and thus to further reduce the routing area RA, thereby further decreasing the bezel size.

Figure 15:
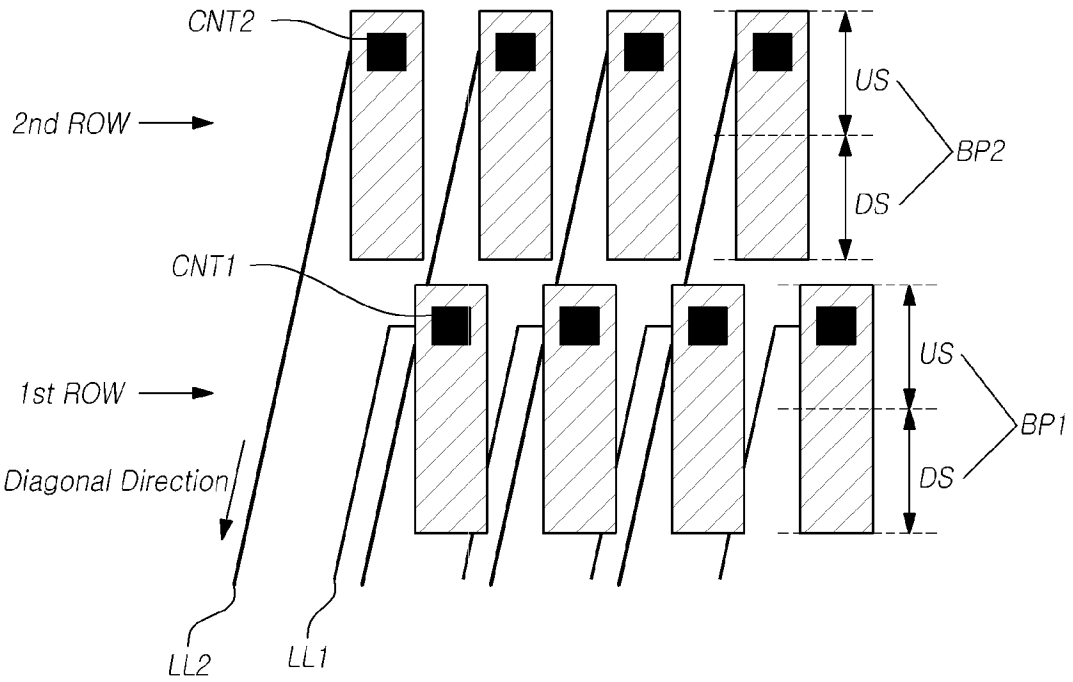
FIG. 15 is a diagram illustrating another example in which the second connection structure of a link line and a pad is applied to the case in which pads are arranged in two rows in a display panel according to embodiments of the present disclosure.

FIG. 15 is a diagram illustrating another example in which the second connection structure of a link line and a pad is applied to the case in which pads are arranged in two rows in the display panel 110 according to one or more embodiments.

Referring to FIG. 15, the upside portion US each of one or more first pads BP1 arranged in the first row is electrically connected to the corresponding first link line LL1, and the upside portion US of each of one or more second pads BP2 arranged in the second row is electrically connected to the corresponding second link line LL2.

In this way, in the multi-row arrangement structure, by employing the same connection structure of the link line and the pad in the rows, it is possible to provide convenience of panel design and processes and to reduce the routing area RA, thereby further decreasing the bezel size.

Figure 16:
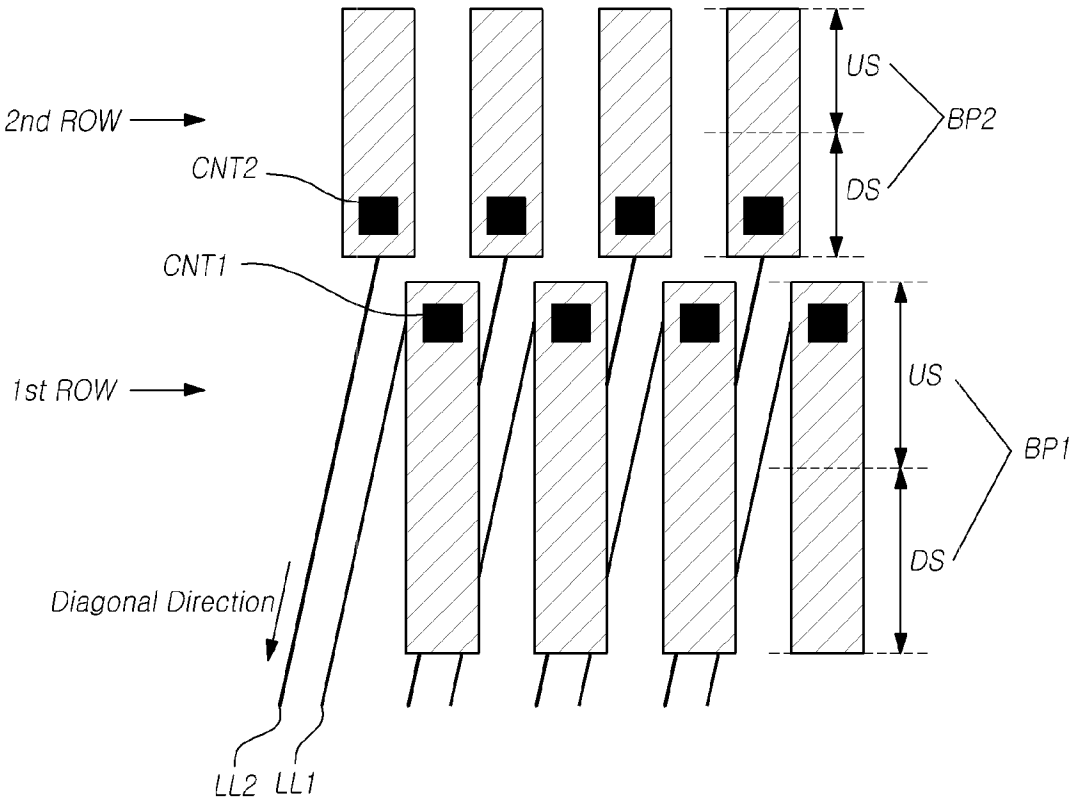
FIG. 16 is a diagram illustrating another example in which the second connection structure of a link line and a pad is applied to the case in which pads are arranged in two rows in a display panel according to embodiments of the present disclosure.

FIG. 16 is a diagram illustrating another example in which the second connection structure of a link line and a pad is applied to the case in which pads are arranged in two rows in the display panel 110 according to one or more embodiments.

Referring to FIG. 16, the length of each of one or more first pads BP1 arranged in the first row is larger than the length of each of one or more second pads BP2 arranged in the second row.

In this way, it is possible to decrease bonding resistance due to an increase in size of the first pads BP1 arranged in the first row and to increase peeling strength, thereby improving reliability.

Figure 17:
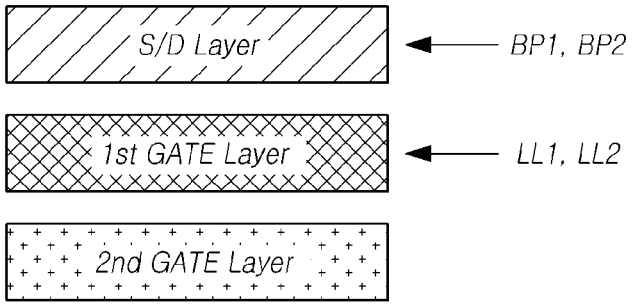
FIGS. 17 to 19 are diagrams illustrating stacked structures of a link line and a pad when the second connection structure of a link line and a pad is applied to the case in which pads are arranged in two rows in a display panel according to embodiments of the present disclosure.
Figure 18:
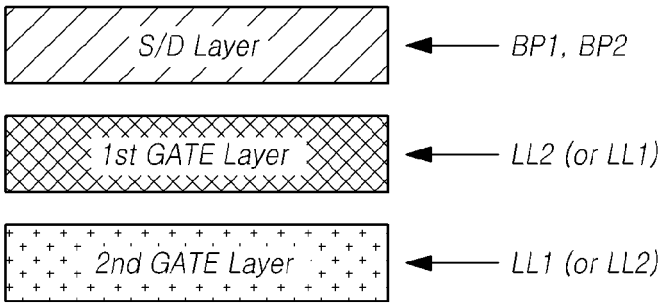
Figure 19:
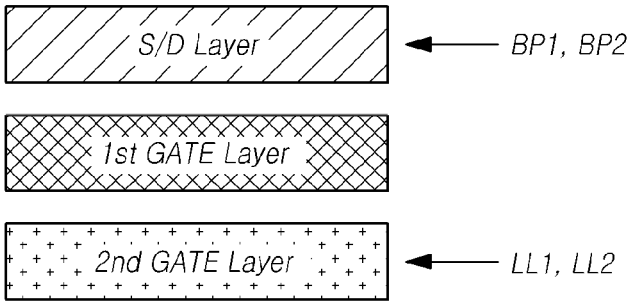

FIGS. 17 to 19 are diagrams illustrating stacked structures of a link line LL and a pad BP when the second connection structure of a link line LL and a pad BP is applied to the case in which pads are arranged in two rows in the display panel 110 according to one or more embodiments.

Referring to FIG. 17, in the multi-row arrangement structure, the first link line LL1 and the second link line LL2 are located in the same layer (for example, a first gate layer).

In this case, the first link line LL1 and the second link line LL2 should be separated from each other in a plan view. That is, in embodiments where the first link lines LL1 and the second link lines LL2 are formed in the same layer, the first and second link lines LL1, LL2 should be separated from each other such that they are not overlapping in direct contact with one another.

In this case, the first link line LL1 and the second link line LL2 can be easily and rapidly formed without increasing the number of panel process steps.

Referring to FIG. 18, in the multi-row arrangement structure, the first link line LL1 and the second link line LL2 are located in different layers (for example, a first gate layer and a second gate layer).

In this case, the first link line LL1 and the second link line LL2 may overlap each other. That is, since the first and second link lines LL1, LL2 are formed in separate layers, they can overlap each other without being in direct contact with one another and therefore are not short-circuited.

In this case, since the number of panel process steps increases (e.g., by forming the link lines in two separate layers), but the first link line LL1 and the second link line LL2 may overlap each other, it is possible to further decrease the length in the column direction of the routing area RA. That is, it is possible to further decrease the bezel size.

On the other hand, referring to FIG. 19, the first link line LL1 and the second link line LL2 may not be formed in a layer (for example, a first gate layer) that is directly below a layer (for example, an S/D layer) in which the first pad BP1 and the second pad BP2 are formed among two layers (for example, the first gate layer and the second gate layer), but the first link line LL1 and the second link line LL2 may instead be formed in the lowest layer (for example, the second gate layer). That is, a layer (e.g., the first gate layer) may be interposed between the layer in which the link lines are formed (e.g., the second gate layer) and the layer in which the pads are formed (e.g., the S/D layer).

In this case, even when the pad area PA is pressed, it is possible to prevent a phenomenon in which a pad and a link line are short-circuited.

An insulating layer may be interposed between the layer (for example, the S/D layer) in which the first pad BP1 and the second pad BP2 are formed and a layer below (for example, the first gate layer).

An insulating layer may be interposed between the layer (for example, the S/D layer) in which the first pad BP1 and the second pad BP2 are formed and two layers below (for example, the first gate layer and the second gate layer).

The display panel 110 according to the above-mentioned embodiments will be described below in brief again.

The display panel 110 according to one or more embodiments includes two or more signal lines SL which are arranged in the column direction in the display area DA, two or more link lines LL which are arranged to be electrically connected to the two or more signal lines SL or to extend from the two or more signal lines SL in the non-display area NDA, and two or more pads BP which are electrically connected to the two or more link lines in the non-display area.

Each of the two or more pads BP includes an upside portion US and a downside portion.

The downside portion DS of each of the two or more pads BP is closer to the display area DA than the upside portion US.

The upside portion US of each of one or more first pads BP1 closest to the display area DA among the two or more pads BP is electrically connected to the corresponding first link line LL1.

The first link line LL1 electrically connected to the upside portion US of each of the one or more first pads BP1 extends in the diagonal direction in the pad area PA in which the two or more pads BP are located.

The display panel 110 according to one or more embodiments includes two or more signal lines SL which are arranged in the column direction (or in the row direction) in the display area DA, two or more link lines LL which are arranged to be electrically connected to the two or more signal lines SL or to extend from the two or more signal lines SL in the non-display area NDA, and two or more pads BP which are electrically connected to the two or more link lines LL in the non-display area NDA.

The two or more link lines LL extend in the diagonal direction in the pad area PA in which the two or more pads BP are located.

The display panel 110 according to one or more embodiments includes two or more signal lines SL which are arranged in the column direction in the display area DA, two or more link lines LL which are arranged to be electrically connected to the two or more signal lines SL or to extend from the two or more signal lines SL in the non-display area NDA, and two or more pads BP which are electrically connected to the two or more link lines LL in the non-display area NDA.

At least one link line of the two or more link lines LL overlaps or is overlapped by at least one pad in the pad area PA in which the two or more pads BP are located.

According to the above-mentioned embodiments, it is possible to provide a display panel 110 and a display device 100 that have a signal transmission structure enabling a narrow bezel design.

According to the present embodiments, it is possible to provide a display panel 110 and a display device 100 that have a small or reduced non-display area NDA.

According to the present embodiments, it is possible to provide a display panel 110 and a display device 100 that can reduce a size of the space (i.e., the routing area RA) between the display area DA in which signal lines SL are arranged and the pad area PA in which pads BP are arranged.

The above description and the accompanying drawings provide an example of the technical idea of the present disclosure for illustrative purposes only. Those skilled in the art will appreciate that various modifications and changes such as combinations, separations, substitutions, and changes of configurations are possible without departing from the essential features of the present disclosure. Therefore, the embodiments disclosed herein are intended to illustrate, not define, the technical idea of the present disclosure, and the scope of the present disclosure is not limited to the embodiments. The scope of the present disclosure shall be construed on the basis of the appended claims in such a manner that all the technical ideas within the range equivalent to the claims belong to the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display device comprising:

a display panel including:

a plurality of signal lines arranged in a column direction in a display area of the display panel;

a plurality of link lines electrically connected to respective ones of the signal lines, the plurality of link lines arranged in a non-display area of the display panel; and a plurality of pads electrically connected to respective ones of the link lines, the plurality of pads being arranged in a pad area within the non-display area, the plurality of pads including at least a first set of pads arranged in a first row that is closest to the display area and a second set of pads arranged in a second row adjacent to the first row; and a driver integrated circuit that is electrically connected to the plurality of pads, wherein each of the pads includes an upper half and a lower half, the lower half of each of the pads is closer to the display area than the upper half, the upper half of each of the first set of the plurality of pads that are closer to the display area than the second set of the plurality of pads includes a respective contact hole that is electrically connected to a corresponding one of a first set of link lines, the contact hole being spaced apart from the display area along a first direction by a first distance, each link line of the first set of link lines extends diagonally from a first location that is spaced apart from the display area along the first direction by at least the first distance to a respective one of the signal lines, and each pad of the first set of the plurality of pads overlaps a corresponding one of a second set of link lines, a portion of the second set of link lines being connected to the second set of the plurality of pads and extending diagonally in the pad area.

2. The display device according to claim 1, wherein the link lines are portions of the signal lines extending diagonally in the pad area.

3. The display device according to claim 1, wherein the pads and the link lines are located in different layers of the display device.

4. The display device according to claim 1, wherein the lower half of each pad of the second set of pads includes a respective contact hole that is electrically connected to the corresponding one of the second set of link lines.

5. The display device according to claim 1, wherein the upper half of each pad of the second set of pads includes a respective contact hole that is electrically connected to the corresponding one of the second set of link lines.

6. The display device according to claim 1, wherein a length of each pad of the first set of pads is larger than a length of each pad of the second set of pads.

7. The display device according to claim 1, wherein the first set of link lines and the second set of link lines are located in a same layer of the display device.

8. The display device according to claim 1, wherein the first set of link lines and the second set of link lines are located in different layers of the display device.

9. The display device according to claim 1, wherein the at least one of the first set of the plurality of pads overlaps at least one of the second set of link lines extending diagonally in the pad area.

10. The display device according to claim 1, wherein the signal lines are data lines.

11. A display device comprising:

a display panel in which two or more signal lines are arranged in a column direction in a display area, two or more link lines electrically connected to the two or more signal lines are arranged in a non-display area, and two or more pads electrically connected to the two or more link lines are arranged in a pad area, each of the two or more link lines extending diagonally in the pad area; and a driver integrated circuit that is electrically connected to the two or more pads, wherein each of the two or more pads includes an upper half and a lower half, the lower half of each of the pads being closer to the display area than the upper half, the upper half of a first pad of the two or more pads that is closest to the display area including a contact hole that is electrically connected to a corresponding one of the two or more link lines, the contact hole being spaced apart from the display area along a first direction by a first distance, wherein the corresponding one of the two or more link lines that is electrically connected to the contact hole extends in a diagonal direction from a first location that is spaced apart from the display area along the first direction by at least the first distance to a respective one of the two or more signal lines, and wherein the first pad of the two or more pads overlaps at least a portion of one of the two or more link lines connected to a second pad adjacent to the first pad and extending diagonally in the pad area.

12. A display device comprising:

a display panel in which two or more signal lines are arranged in a column direction in a display area, two or more link lines electrically connected to and extending from the two or more signal lines are arranged in a non-display area, and a row of two or more pads electrically connected to the two or more link lines are arranged in the non-display area, the two or more pads electrically isolated and spaced apart from one another in a row direction that is perpendicular to the column direction, each of the two or more pads having an upper half and a lower half, the lower half being closer to the display area than the upper half; and a driver integrated circuit that is electrically connected to the two or more pads, wherein a first link line of the two or more link lines is electrically connected to the upper half of a first pad of the two or more pads and extends in a diagonal direction between the first pad and an adjacent second pad of the row of two or more pads in a pad area, and wherein at least a portion of the first link line is overlapped by and electrically isolated from the second pad in the pad area.

13. A display panel comprising:

a plurality of signal lines that are arranged in a column direction in a display area;

a plurality of link lines that are arranged to be electrically connected to the signal lines in a non-display area, the plurality of link lines including a first set of link lines and a second set of link lines; and a plurality of pads that are electrically connected to the link lines in a pad area within the non-display area, each of the plurality of link lines extending diagonally in the pad area the plurality of pads including a first set of pads and a second set of pads, the first set of pads located between the display area and the second set of pads, wherein each of the pads includes an upper half and a lower half, the lower half of each of the pads is closer to the display area than the upper half, the upper half of each of the first set of pads includes a respective contact hole that is in direct contact with and electrically connected to a corresponding link line of the first set of link lines at a location that is spaced apart from the display area along a first direction by a first distance, each link line of the first set of link lines extends diagonally from a first location that is spaced apart from the display area along the first direction by at least the first distance to a respective one of the signal lines, and each pad of the first set of the plurality of pads overlaps a corresponding link line of the second set of link lines, a portion of the second set of link lines being connected to a second set of the plurality of pads and extending diagonally in the pad area.

14. The display panel according to claim 13, wherein the link lines are portions of the signal lines extending diagonally in the pad area.

15. A display panel comprising:

two or more signal lines that are arranged in a column direction in a display area;

two or more link lines that are arranged to be electrically connected to and extending from the two or more signal lines in a non-display area; and a row of two or more pads that are electrically connected to the two or more link lines in the non-display area, the two or more pads electrically isolated and spaced apart from one another in a row direction, each of the two or more pads having an upper half and a lower half, the lower half being closer to the display area than the upper half, wherein each of the two or more link lines includes a first portion which extends along the row direction from one side of the upper half of a respective one of the two or more pads, and a second portion which extends in a diagonal direction from the first portion to a respective one of the two or more signal lines, wherein the second portion of one of the two or more link lines that is connected to a first pad of the two or more pads is overlapped by and electrically isolated from an adjacent second pad of the two or more pads in the pad area.

16. A display panel comprising:

a plurality of signal lines that are arranged in a column direction in a display area;

a plurality of link lines that are arranged to be electrically connected to the plurality of signal lines in a non-display area; and a plurality of pads that are electrically connected to the plurality of link lines in the non-display area, the plurality of pads including a first row of pads and a second row of pads, the first row being closer to the display area than the second row, each of the plurality of pads having an upper half and a lower half, the lower half being closer to the display area than the upper half, wherein the plurality of link lines includes a first set of link lines electrically connected to the first row of pads and a second set of link lines electrically connected to the second row of pads, each of the first set of link lines extending diagonally from the upper half of a respective pad of the first row of pads to a respective one of the signal lines, each of the second link lines extending diagonally from a respective pad of the second row of pads to a respective one of the signal lines, wherein at least one of the pads of the first row of pads overlaps and is electrically isolated from at least one of the second set of link lines in a pad area in which the plurality of pads is located.

17. The display panel according to claim 16, wherein the link lines are portions of the signal lines in the pad area.

* * * * *